US005526654A

United States Patent [19]

Carter

[11] Patent Number: 5,526,654

[45] **Date of Patent: *Jun. 18, 1996**

[54] BODY DECORATION AND METHOD OF USING SAME

[76] Inventor: Mary J. Carter, 287 Surrey Dr., Bonita, Calif. 91902

[ * ] Notice: The term of this patent shall not extend beyond the expiration date of Pat. No. 5,363,675.

[21] Appl. No.: 252,822

[22] Filed: Jun. 2, 1994

Related U.S. Application Data

[63] Continuation-in-part of Ser. No. 91,778, Jul. 14, 1993, Pat. No. 5,363,675.

[51] Int. Cl.[6] ..... A44C 7/00; A44C 25/00

[52] U.S. Cl. ..... 63/14.1; 63/2

[58] Field of Search ..... 63/2, 1.1, 12, 14.1, 63/14.2, 14.8

[56] References Cited

U.S. PATENT DOCUMENTS

| | | | |
|---|---|---|---|
| 468,883 | 2/1892 | Marsters | 63/14.2 |
| 1,576,372 | 3/1926 | Shea | 63/14.2 |
| 2,409,369 | 10/1946 | Lo Curto | 63/14.2 |
| 2,443,051 | 6/1948 | Miller | 63/14.2 |
| 3,163,026 | 12/1964 | Kenny | 63/14.2 |
| 3,898,868 | 8/1975 | Tomlinson | 63/14.1 |
| 5,035,123 | 7/1991 | Kogen | 63/14.3 |
| 5,184,482 | 2/1993 | Cloud | 63/14.1 |

*Primary Examiner*—Flemming Saether
*Attorney, Agent, or Firm*—Bernard L. Kleinke; Jerry R. Potts; Peter P. Scott

[57] ABSTRACT

A body decoration, and a method of using it, includes a main ornamentation body, secured and supported in place on the body of a wearer by a flexible pliable fine threadlike line such that it remains substantially invisible to an observer, to enhance the appearance of the wearer. A cushion device is attached to the line to protect the skin of the wearer. Embodiments of the present invention can be adapted to be worn in various locations on the body, such as the head, the face, the ear, the neck, the finger, the hand, and the hair.

15 Claims, 10 Drawing Sheets

Fig. 2
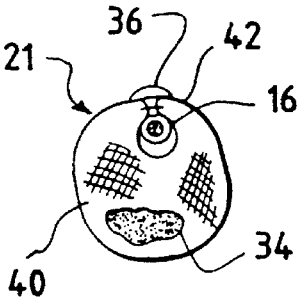
Fig. 3
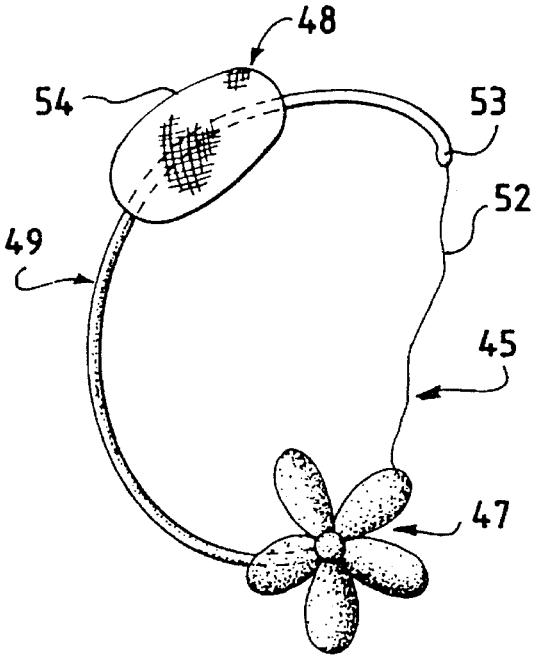
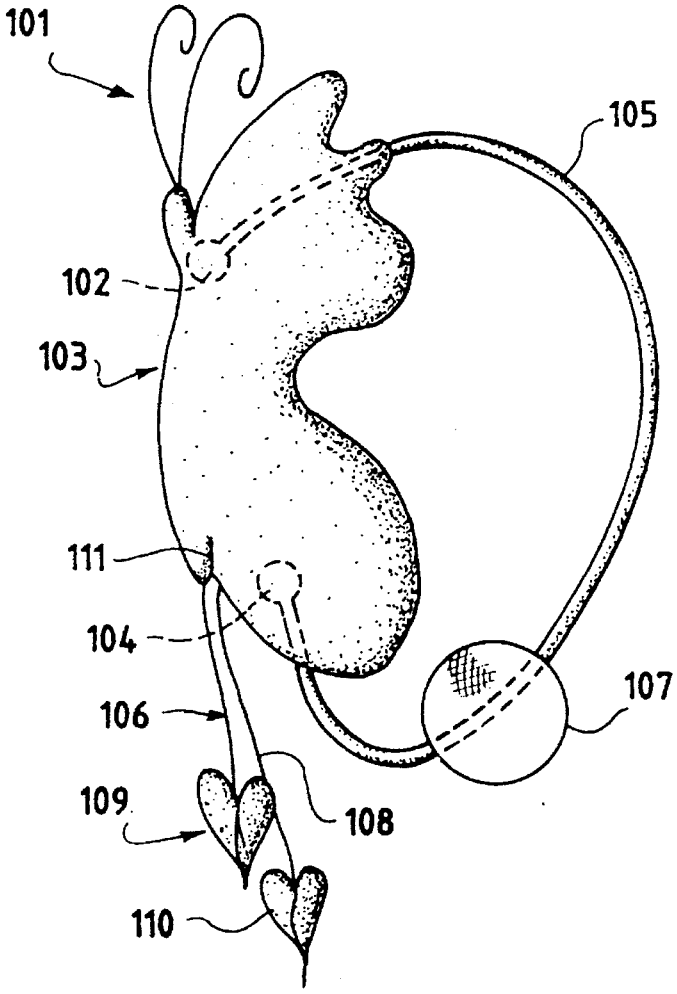
Fig. 3A

BODY DECORATION AND METHOD OF USING SAME

CROSS-REFERENCE TO RELATED APPLICATIONS

This application is a continuation-in-part of U.S. patent application Ser. No. 08/091,778, filed Jul. 14, 1993, entitled "Face Decoration and Method of Using Same." now U.S. Pat. No. 5,363,675, which is incorporated herein by reference thereto.

TECHNICAL FIELD

The present invention relates in general to a decoration for the body, and a method of using the decoration. The invention more particularly relates to such a decoration worn adjacent to various parts of the body, such as the face, the ear, the hair, the neck, the hand, or the finger, as well as being attached to an undergarment.

BACKGROUND OF THE INVENTION

Decorating the human body in the past has involved techniques such as the application of colored pigments to the skin in desired arrangements. These techniques require a large expenditure of time, both in applying the decoration and in removing the decoration. In the case of a tatoo, the decoration is semi-permanent and requires a surgical-like procedure for removal thereof. Thus, these techniques are not suitable for the person who wishes to apply or remove a decoration in an easy manner.

Various decorations have been contemplated for attaching to the ear with little effort and provide the ear with ornamentation. Examples of such decorations, though considered less pertinent as they are not facial decorations, are disclosed in U.S. Pat. Nos. 89,452; 236,935; 2,409,369; 2,453,485; 2,498,748; 2,502,386; 2,526,087; 3,958,430; 4,282,721; and 4,827,738.

U.S. Pat. No. 4,803,853 discloses an ornamental ear insert which is adapted to be inserted and retained in the external ear. A resilient metal mesh screen having folds throughout and a hook at its upper and lower portions, permit the ornamental ear insert to be secured to the ear. In use, the mesh screen is compressed and inserted into the external ear, concealing the ear canal. When released, the mesh screen expands and presses against the external ear, thereby securing the ornamental ear insert. For additional fastening purposes, the hooks are placed between the external ear and the skull. The hooks bend into the outer portion of the external ear to prevent the upper and lower portions of the ornamental ear insert from being displaced.

Although the above described ornamental ear insert attaches relatively easily, it does not provide ornamentation for the face. Such an ornament is limited to placement within the ear. The expansion property of the mesh screen is ineffective outside of the ear as there are no features on the face which the mesh screen can expand against.

Thus, it would be highly desirable to have a facial decoration which may be easily attached and removed. Such a decoration should be firmly supported and yet should rest on the face in a position forward of the ear for decorative purposes.

A technique which provides an adornment in the form of an earring, which can be applied or removed with relative ease, is described in U.S. Pat. No. 4,993,240. There, a hook or J-shaped rigid bar or strip is placed behind the ear and an end leg portion of the J-shaped strip is secured to the pierced earlobe by an earring stud and bracket. Connected to the curved upper portion of the J-shaped strip is a decorative member extending downwardly in front of the ear. There is a provision for adjusting the size of the strip to accommodate different sized ears. In this regard, the end leg portion is adapted to receive the earring stud in different openings in the strip wherein the stud is held in position by the bracket.

While such an arrangement may be adapted to fit various ear sizes, it requires the strip to be in contact with the back portion of the ear in at least two different positions. In this regard, the strip contacts the back portion of the ear at the ear lobe and at the top of the ear where the adornment extends in front of the ear. Depending on the shape of the ear, another contact area may exist. For example, where the radius of curvature of the rear portion of the ear is less than that of the decorative member, the strip contacts an intermediate portion of the rear portion of the ear. Such extensive contact with the ear can result, under certain circumstances, in discomfort to the wearer due to pressure exerted against the ear by the strip.

Where the strip contacts the ear at the intermediate portion and the top of the ear, the discomfort results from the sensitivity of the soft skin on the rear portion of the ear. The strip contacts the soft skin along a discrete line of engagement at the two aforementioned positions. Thus, the force exerted by the strip on the soft skin of the rear portion of the ear is concentrated at two areas. The result of the concentrated forces is an indentation in the skin which is translated into discomfort, and even pain, for the user.

Further discomfort is realized by the user where the strip is permitted to move along the surface of the soft skin. As the curved upper portion of the J-shaped strip merely rests on the top of the ear, the strip is free to rotate about the earring stud. When the strip does rotate, for example, when the wearer is dancing, the strip rubs against the soft skin of the ear at the intermediate portion and at the top of the ear. The rubbing of those two locations results in discomfort and may lead to abrasions from the frictional forces between the strip and the soft skin.

The use of an earring to support the strip at the ear lobe adds to the discomfort of the user. Substantially all of the mass of the ear decoration is located above the point where the earring stud connects the strip to the ear lobe. Thus, the ear lobe must support the strip, counteracting the downward force exerted by gravity. As the ear lobe is relatively small and thin, the downward force is not well distributed and results in a concentrated pressure point causing discomfort.

A user may object to the use of an earring attachment for reasons other than those of discomfort. For instance, maintaining good hygiene may be a consideration where pierced ears are required to support the ear decoration. If the user chooses not to have pierced ears, for whatever reason, the use of an earring support cannot be used to support a decoration. Furthermore, the user may object to the appearance of non-aesthetically pleasing components of the decoration.

The decoration disclosed in U.S. Pat. No. 4,993,240 is adaptable to different sizes of ears. All that is required to adjust the size of the decoration is to select a new opening in which to insert the ear stud. A large ear size requires the ear stud to be placed in an opening farthest from the top of the ear, while a small ear size requires the ear stud to be placed in an opening closer to the top of the ear than for a large ear. In the case of a small ear, the appropriate opening is selected, leaving a portion of the strip to extend downwardly below the ear lobe. The downwardly extending portion contains unused openings and detracts from the appearance of the decoration.

Another drawback to such a decoration is the manner in which the user attaches the decoration to the ear. Although applying and removing the decoration can be done without special tools, unlike a tatoo, it is at best an awkward procedure. The user must perform a number of procedures simultaneously in order to be successful. The strip must be held so that the openings in the end leg portion are aligned with the hole in the ear lobe. The bracket must be placed and held behind the appropriate hole. Additionally, the earring stud must be aligned with the hole in the ear lobe as well.

To accomplish all of the foregoing manipulations at the same time, such an awkward procedure would seem to be better performed by four hands, rather than by one person. Under some conditions, such as in a dimly lit room, in an automobile, or without the benefit of a mirror, such a task would seem extraordinarily awkward, no matter how many hands were available.

Thus, it would be highly desirable to have a facial decoration which is constructed and arranged such that it engages the ear from the front and, therefore, requires only very little contact with the ear at its upper and lower parts to support the decoration.

Such a device should be capable of being adjusted readily to various ear sizes without adding excessive weight to the decoration or adding unappealing obtrusive support members. Furthermore, such a device should provide additional decoration behind the ear to further enhance the aesthetic appearance of the ear.

The foregoing mentioned copending patent application U.S. Ser. No. 08/091,778, filed Jul. 14, 1993, entitled, "Face Decoration and Method of Using Same," effectively solved the foregoing problems, relating to providing secure attachment, comfort to the wearer, aesthetically pleasing appearance, and ease of attachment. However, while the inventive decorations disclosed in the foregoing mentioned patent applications have proven to be highly satisfactory for many applications, it would be highly desirable to have a decoration, which even more greatly enhances the flexibility, comfort and system of support, and to facilitate the wearing of decorations in different locations on the body.

Although the invention of the aforementioned copending patent application functions well to adorn the face and ear for many applications, it would be highly desirable to have a body decoration with the flexibility to adorn many locations of the body. Such a body decoration should have features which make the decoration adaptable to be worn adjacent to various portions of the body, such as the face, the ear, the hair, the neck, a finger, and the hand, as well as being attached to an undergarment.

Although the invention of the aforementioned patent application provides adequate support to hold the decorative member in place on the face or ear, improved support members would allow the decorative member to be much larger in size and yet decrease the likelihood that the body decoration may shift or inadvertently be dislodged. Moreover, such an improved body decoration should be substantially invisible to an observer in order to enhance the appearance of the wearer, and not detract from the aesthetically pleasing appearance of the decoration.

Another problem frequently encountered when adorning the body with many types of ornamentation is comfort. A wearer of a decoration desires comfort because many times a decoration is worn for extended periods of time. A body decoration can rub against sensitive skin tissue of the wearer, thereby irritating the skin where the decoration makes contact with the body of the wearer. This can be particularly troublesome where a large, heavier decoration is worn for extended periods of time.

Therefore, it would be highly desirable to have a new and improved body decoration which not only incorporates some of the inventive features disclosed in the prior patent application, but also has added flexibility as to where it can be worn, comfortable support for larger, heavier decorations, while providing comfort to the wearer for long periods of time.

DISCLOSURE OF INVENTION

Therefore, it is the principle object of the present invention to provide a new and improved body decoration, and method of using it, wherein the decoration can be large in size and worn in several locations on the body in a secure manner such that the wearer does not suffer undue discomfort, and the decoration is secured to the body of the wearer without disclosing the means of support, thereby enhancing the appearance of the wearer.

Another object of the present invention is to provide such a new and improved body decoration, and method of using it, which is adaptable to be used by many people at a variety of different positions on the body, and which fits universally various different sizes and shapes of persons wearing the decoration.

Briefly, the above and further objects and features of the present invention are realized by providing a body decoration, and a method of using it, wherein the decoration can be larger in size an can be worn at a variety of positions on the body in a comfortable manner, without any visible means of support.

The decoration includes a main ornamentation body for positioning on the body of a user at various locations of the body, and is secured and supported on the body by flexible pliable fine threadlike line so as to be substantially invisible to an observer to enhance the appearance of the wearer. A cushion device is attached to the line to protect the skin of the wearer. Additionally, the flexible pliable line is positioned. Embodiment of the present invention may be utilized to decorate the body by being worn on the head, adjacent to the face, on the ear, on the neck, on a finger, on the hand, or in the hair. Another embodiment is attached to the undergarment of the wearer to be worn on the upper body of the wearer.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 2 is an enlarged, partially broken away cross sectional view of a cushion device of the decoration of FIG. 1;

FIG. 3 is a front elevational view of another body decoration which is also constructed in accordance with the present invention;

FIG. 3A is a front elevational view of still another body decoration which is also constructed in accordance with the present invention;

BEST MODE FOR CARRYING OUT THE INVENTION

Figure 1:
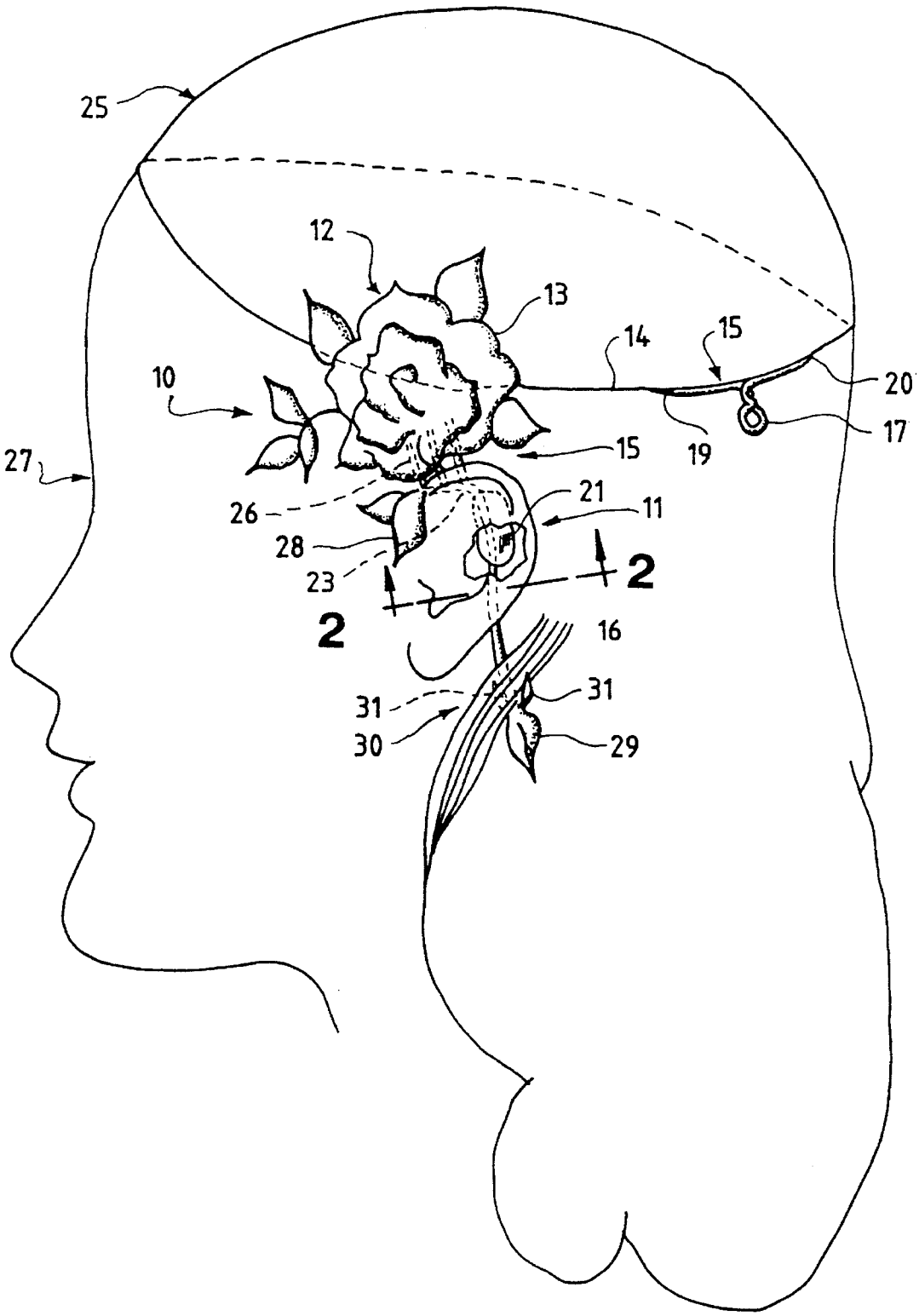
FIG. 1 is a front elevational view of a body decoration which is constructed in accordance with the present invention, and which is shown attached in place above the ear and at the hair of the wearer.

Referring now to the drawings, and more particularly to FIG. 1 thereof, there is shown a body decoration 10 which is constructed according to the present invention. The body decoration 10 is worn on the face of the wearer 27 above or adjacent to the ear 11. An advantage of this body decoration is that it enhances the appearance of the user in that the ornamental portion of the decoration is supported by points of attachment invisible to an observer.

The ornamental portion 12 of the face decoration 10 is supported by a loop of fine threadlike line 14 encircling the crown 25 of the head of the wearer 27. This loop of fine threadlike line 14 is hidden from view beneath the hair of the wearer. The face decoration 10 is further stabilized and held in position by the placement of a flexible pliable wire 16 that conforms to, and lies within, the upper pinna portion 23 of the ear 11 of the wearer 27. A group of wires 15 such as wire 26 connects the ornamental portion 12 to the flexible pliable wire 16. A cushion device 21 is connected to the wire 16 and can be conformed to fit the outer groove of the upper pinna 23 portion of the ear 11, to cushion the face decoration 10 and facilitate comfort for the wearer 27. An ornamental body 29 is located at the distal end of the wire 16 to both enhance the appearance of the wearer 27 and to further stabilize the face decoration 10 when the ornamental body 29 is placed beneath the hair 30 of the wearer 27. Connected to the loop of fine threadlike line 14, is a section of flexible pliable wire 18 which can be twisted to accommodate the head size of the wearer 27.

In wearing the decoration 10, the decoration 10 is placed on the side face portion of the wearer 27 in the vicinity of the ear 11, with the fine threadlike line loop placed upon the crown of the head 25. The flexible pliable wire 16 is conformed to the upper pinna ear portion 23 of the user 27, then placed so as to rest in the groove formed by the intersection of the upper pinna ear portion 23 and the head of the user 27. Once the flexible pliable wire 16 is in place resting within the groove formed between the upper pinna ear portion 23 and the head of the user 27, the cushion device 21 is shifted along the wire 16 until it reaches a pressure point. The cushion device 21 is then shaped so as to cushion the decoration 10 and enhance the comfort of the user 27.

Considering now the body decoration 10 in greater detail, the ornamental portion generally includes a decorative member 12. Although a flower motif is illustrated in FIG. 1, this decorative member could be made of any shape or color. The base member 13 of the decorative member 12 acts to support the ornamental portion as well as provide connection points for the fine threadlike line loop 14 and the group of wires 15, such as wire 26.

Considering now the fine threadlike line loop 14 in greater detail with reference to FIG. 1, a section of flexible pliable wire 18 is connected to the fine threadlike line loop 14 at points 19 and 20. This wire portion 18 of the loop 14 can be twisted to shorten and untwisted to lengthen the loop 14 in conforming to the head size of the wearer 27. In operation, the wearer places the loop around the crown 25 of the head, to support the body decoration 10. Next, the wire portion 18 of the fine threadlike line loop 14 is either twisted or untwisted to conform to the head size of the wearer. Finally, the fine threadlike line loop 14 can be hidden from view by locating the loop 14 beneath the hair of the wearer 27. In this way, the body decoration 10 is adequately supported on the head of the wearer 27, and the body decoration 10 enhances the appearance of the wearer 27 without the supporting means being visible to an observer.

Considering now the flexible pliable wire 16 in greater detail with reference to FIG. 1, the flexible pliable wire 16 is attached to the ornamental element 12 by a group of wires 15 preferably made of flexible pliable wires to aid in the adjustment of the body decoration 10 on the head of the user 27. The flexible pliable wire 16 can be conformed to fit into the groove between the upper pinna portion of the ear 11 and the head of the user 27. The cushion device 21 can be readily moved along the wire 16 and placed at any point therein. At the distal ends of the wire 16 are ornamental bodies 28 and 29. Ornamental body 28 acts to hold the wire 16 in place on the ear 11 of the user 27. Ornamental body 29, while enhancing the appearance of the wearer, can also act to stabilize the wire 16 by being placed behind the hair 30 of the wearer 27. Barbs 31 on the ornamental body 29 may engage the hair 30 to increase the stability of the body ornament, and further hold it in place on the head of the wearer.

In operation, the wearer 27 would place the body ornament 10 on the head. The fine threadlike line loop 14 is set in place encircling the crown 25 of the wearer's head to support the ornament in the desired location on the head. This loop 14 is then adjusted to fit the head size of the wearer 27. Next, the flexible pliable wire 16 is shaped to conform to the groove between the upper pinna portion of the wearer's ear 11 and the wearer's head. Following placement of the wire 16 into the groove, the cushion device 21 is moved into place, shaped to fit the wearer and pushed into place between the ear 11 and head of the wearer. Finally, the ornamental body 29 is placed behind the hair 30 of the user and the barbs 31 are utilized to increase the stability, overall, of the body decoration 10.

Considering now the cushion device 21 in greater detail with reference to FIG. 2, the cushion device 21 is connected to the flexible pliable wire 16. The cushion device 21 is preferably made of a puttylike substance 34 contained within a fabric covering 40. The puttylike substance 34 consists of Physician's Choice™ silicone clear putty, or any other silicone clear putty, or any other malleable putty or malleable material suitable for conforming to human ear shapes and usable for stabilizing and cushioning the ornamental portion 12 of the body decoration 10. The fabric covering may be made of any suitable fabric, including, but not limited to silk, cotton, nylon, or other synthetic fabric.

Considering now the cushion device 21 in greater detail with reference to FIG. 2, the cushion device 21 is constructed by containing the puttylike substance 34 within a fabric covering 40, then surrounding the flexible pliable wire 16. The cushion device 21 is held on the wire 16 by a sewn connection 42, or other suitable connection means. The connection point 42 may be hidden from view by placement of an ornamental cap 36 over the connection point 42. Because the cushion device 32 is not directly attached to the wire 16, the cushion device 21 can be moved along the wire 16 and placed in the most advantageous location to provide optimal cushioning of the body decoration 10. In this way, the body decoration is secure, fits snugly, and is comfortable for the wearer.

In operation, the cushion device 21 acts to cushion and stabilize the body decoration 10. Following placement of the flexible pliable wire 16 on the ear 11 of the wearer 27, the cushion device 21 is adjusted to a location of a point of pressure on the ear 11 of the wearer 27 due to the weight of the body decoration 10 and gravity. Once in place behind the upper pinna portion of the ear 11 of the wearer 27, the cushion device can be conformed to fit snugly into the groove formed between the upper pinna portion of the ear 11 and the head of the user. In this way, the cushion device adds considerable comfort to the wearer, and remains invisible to an observer.

Referring again to FIG. 2, there is shown an enlarged cross sectional view of the cushion device 21. The puttylike substance 34 lies within an outer fabric covering 40 and is connected to the wire 16 by being looped around the wire 16 and fastened together at a connection point 42. It should be readily apparent to one skilled in the art that this connection may be made by sewing, gluing, or stapling the fabric together, or any other suitable means for effecting a secure connection of fabric. The connection point 42 is then hidden from view by a decorative cap 36. While within the fabric covering 40 the puttylike substance 34 can be conformed to the outer groove between the upper pinna portion of the ear 11 and the head of the user 27. This would stabilize the body decoration 10 and cushion the wire 16 attached to the wearer 27.

Referring now to FIG. 3, there is shown a body decoration 45, which is similar to the decoration 10, except the decoration 45 does not have fine threadlike line loop 14 and decorative member 12. The decoration 45 is adapted to be worn on the ear of the wearer. An ornamental body 47 is connected to a flexible pliable wire 49 with a cushion device 48 having a puttylike substance (not shown) within a fabric covering 54 surrounding a portion of the wire 49. The cushion device 48 is similar to the cushion device 21 of FIGS. 1 and 2, and serves the same function. Connected between the ornamental body 47 and the opposite end of the wire 49 is a fine threadlike line 52 which together with the wire 49 forms a closed loop.

The body decoration 45 includes an ornamental body 47 connected to a flexible pliable wire 49. A fine threadlike line 52 is connected to the distal end 53 of the flexible pliable wire 49 and the ornamental body 47. A cushion device 48, as described above in FIGS. 1 and 2, is movably disposed on the flexible pliable wire 49.

In wearing the decoration 45, the decoration 45 is placed on the ear of the wearer so that the flexible pliable wire 49 sits in the groove between the upper pinna portion of the ear and the head of the wearer. Once in place, the cushion device 48 is positioned at a point on the wire where maximum comfort is attained for the wearer. The puttylike substance (not shown), within the fabric covering 54 of the cushion device 48, is conformed to the shape of the space between the upper pinna portion of the ear and the head of the user. In this way, the decoration 45 remains snug, fits comfortably, and is secure from unwanted shifting or loss. In addition, the decoration 45 enhances the appearance of the wearer, more so because the cushion device 48 is not visible to an observer. The fine threadlike line 52, spanning the distance between the distal end of the flexible pliable wire 49 and the ornamental body 47, also adds stability to the decoration 45, by supporting the ornamental body under the ear of the wearer. Moreover, the closed loop configuration achieved in decoration 45 makes it much more likely that the decoration 45 will remain in place and will not be lost by falling off. This is because the closed loop of decoration 45 fits over the ear of the wearer. The flexible pliable wire 49 can be twisted onto itself in a similar fashion to the adjustment wire portion 18 of FIG. 1. In this way, the body decoration 45 can be adjusted to snugly fit onto the ear of a wearer regardless of ear size.

Referring now to FIG. 3A, there is shown a body decoration 101 constructed in accordance with the present invention. Body decoration 101 in FIG. 3A is to be worn on the ear of a wearer, in a similar fashion to the body decoration 45 described above and illustrated in FIG. 3. Decoration 101 differs from decoration 45 in that it has a flexible pliable wire 105 connected to an ornamental element 103 at connection points 102 and 104. A cushion device 107, as described above for FIG. 3, is movably attached to the flexible pliable wire 105. Other ornamental bodies 109 and 110 may be disposed below the ornamental element 103 by being connected to fine threadlike lines 106 such as fine threadlike line 108, which are connected to the ornamental element 103, at connection point 111.

In wearing decoration 101, the wearer positions the flexible pliable wire 105 over the ear. The cushion device 107 is then moved into position so as to relieve pressure caused by the decoration 101, conformed to the shape of the groove formed between the upper pinna portion of the ear and the head of the wearer. In this way, the cushion device 107 makes wearing the decoration 101 more comfortable as it cushions possible pressure points caused by the positioning of the supporting wire 105 with respect to the ear and head of the wearer. To adjust the size of the decoration 101, the flexible pliable wire 105 can be twisted onto itself as in decoration 45 of FIG. 3.

Figure 4:
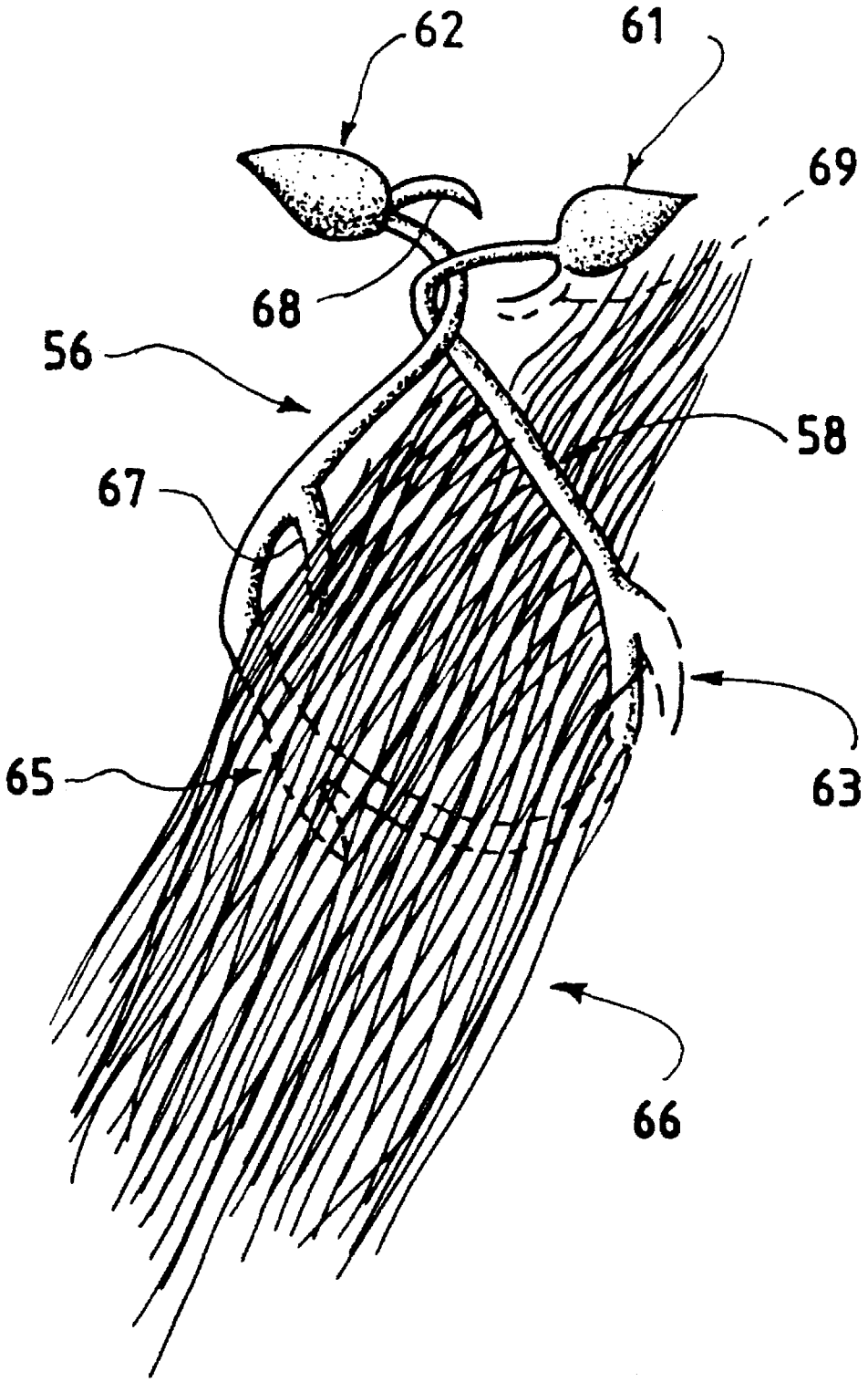
FIG. 4 is a front elevational view of a further body decoration constructed in accordance with the present invention, and which is shown attached in place surrounding a hank of hair of the wearer.

Referring now to FIG. 4, there is shown a body decoration 56, in place attached to a hank of hair 66 of a wearer. A flexible pliable wire 58 with ornamental bodies 61 and 62 is wrapped around a hank of hair 66 and then the distal ends of the wire containing the ornamental bodies 61 and 62 is twisted to hold the decoration 56 in place relative to the hair 65 of the wearer. Additionally, barbs 63, 65 and 67 connected to the wire 58 stabilize and help hold the body decoration 56 in place, by piercing the hank of hair 66 at various locations along the wire 58.

Considering now the body decoration 56 in greater detail with reference to FIG. 4, the decoration 56 is primarily made of a flexible pliable wire 58 with ornamental bodies 61 and 62 positioned at the two distal ends of the wire 58. Positioned along the wire 58 are several rigid barbs 63, 65 and 67. Other rigid barbs 68 and 69 are located on ornamental bodies 61 and 62.

In operation, when the decoration 56 is in place in the hair 65 of the wearer, the flexible pliable wire 58 is twisted so as to surround a hank of hair 66. The rigid barbs 63, 65 and 67 are pushed into the hair 66 to stabilize the decoration, and to hold it in place and minimize shifting. The rigid barbs 68 and 69 associated with the ornamental bodies 61 and 62 at the distal ends of the wire 58, are also pushed into the hank of surrounded hair 66. This adds to the stability of the decoration 56 and acts to hold the decoration 56 in place in the hair 66 of the wearer, with minimal shifting.

Figure 5:
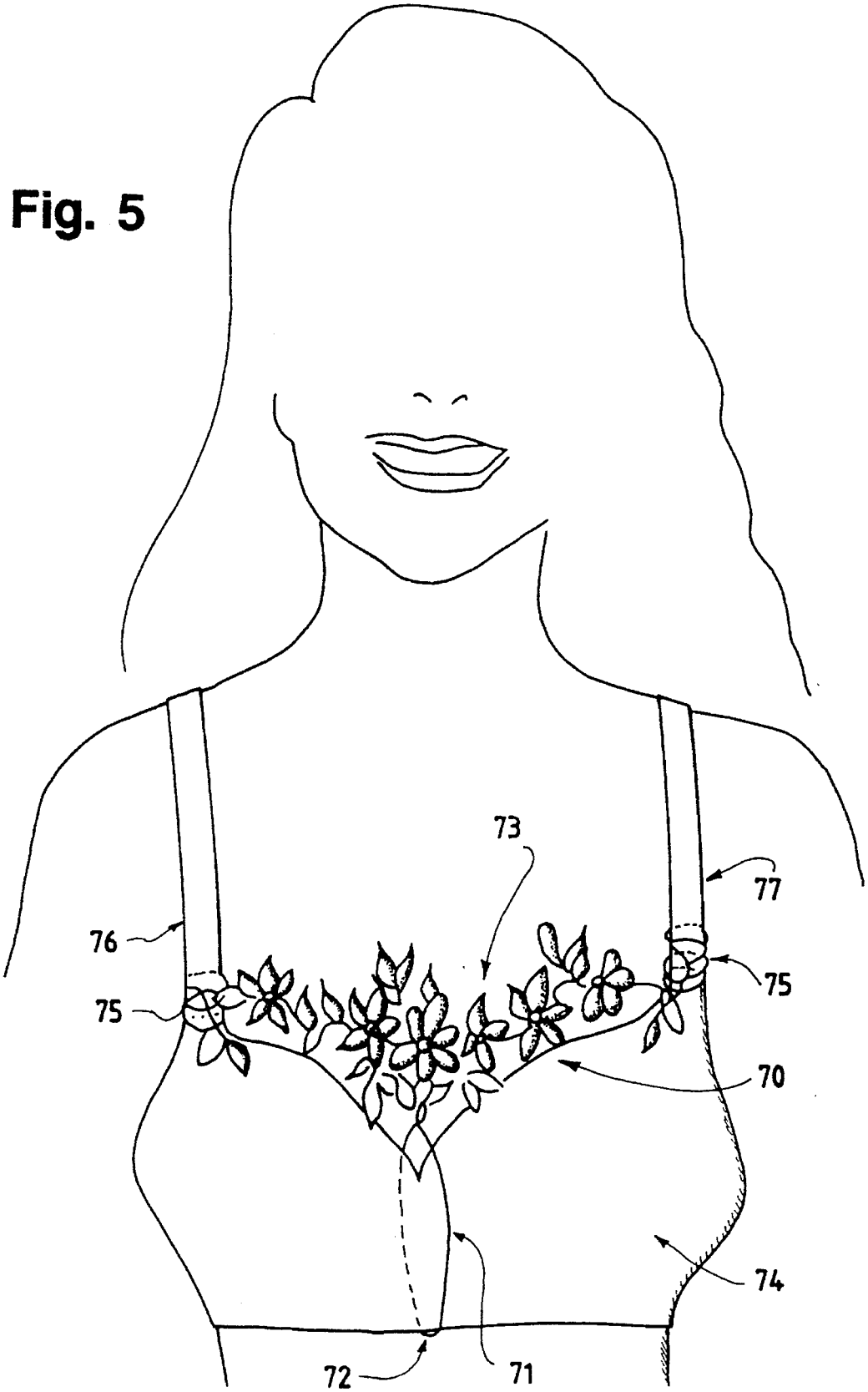
FIG. 5 is a front elevational view of still another body decoration which is also constructed in accordance with the present invention, and which is shown attached in place to the undergarment of the wearer.

Referring now to FIG. 5, there is shown another body decoration 70, attached to the undergarment 74 of a wearer. Ornamental bodies 73 are placed along a flexible pliable wire 71. Distal portions of the wire 75 are devoid of ornamental bodies and are wrapped around the undergarment straps 76 and 77 to support the undergarment decoration 70, and hold it in place on the undergarment of the wearer. The center portion of the supporting wire 71 is also devoid of ornamental bodies and is looped around the front midsection area of the undergarment 72 to further stabilize the decoration 70.

Considering now the body decoration 70 in greater detail with reference to FIG. 5, the decoration 70 is worn attached to an undergarment 74 being worn by the user. FIG. 5 illustrates the decoration 70 being worn attached to a bra-type undergarment, however the decoration construction lends itself to attachment to other undergarments and other articles of clothing. An ornamental portion 73 is flanked by flexible pliable wire 75 which is devoid of ornamental bodies. These distal ends of the wire 75 can be wrapped around the undergarment strap 76 and 77, to support the decoration 70 and hold it in place on the chest of the wearer. Furthermore, a flexible pliable wire 72 running down from the central portion of the ornamental element 73 of the decoration 70 is looped around the mid-section of the undergarment 72 to provide greater stability and hold the decoration 70 in place on the chest of the wearer.

Figure 6:
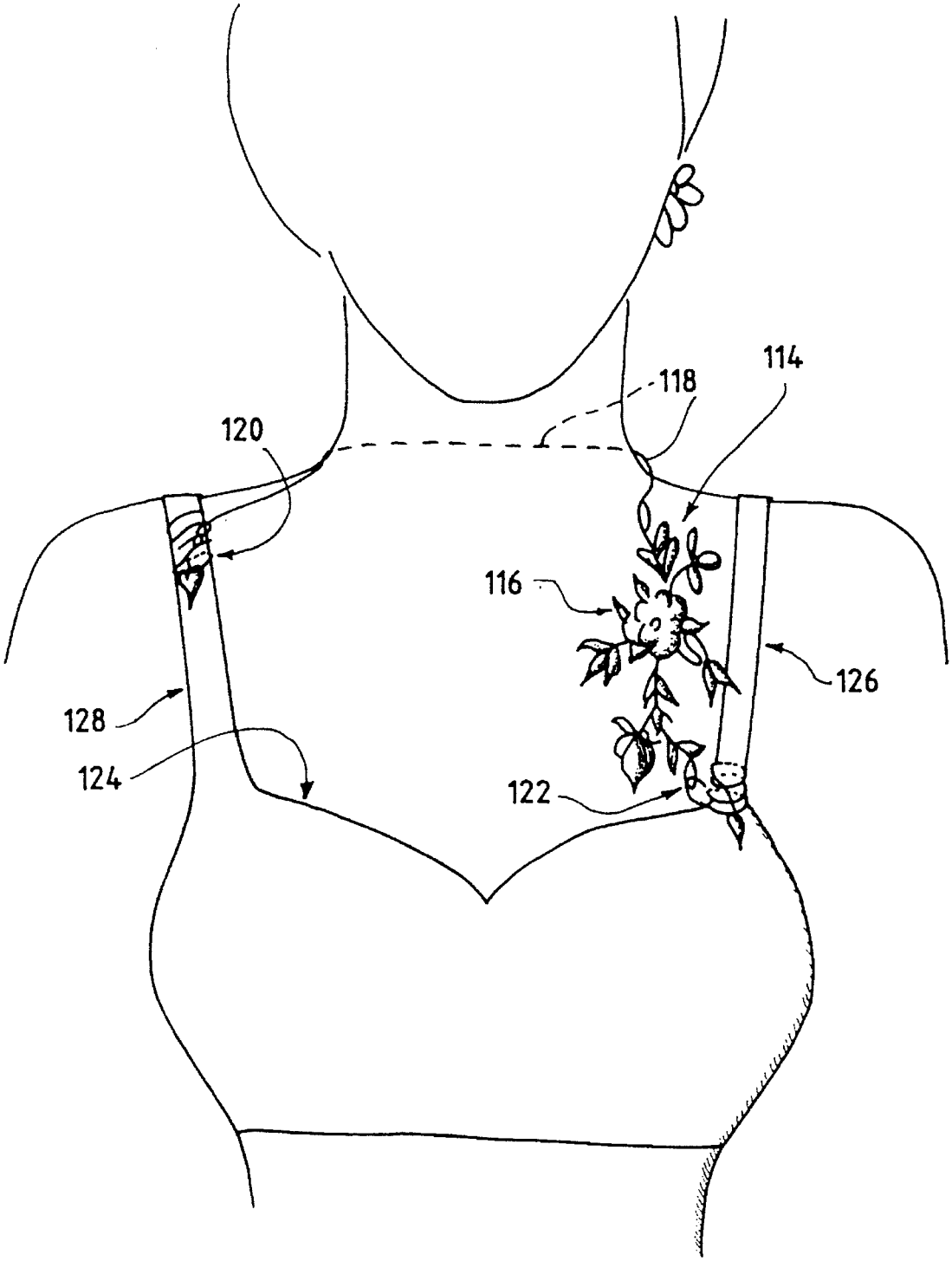
FIG. 6 is a front elevational view of yet another body decoration which is also constructed in accordance with the present invention, and which is shown attached in place to the undergarment of the wearer.
Figure 6A:
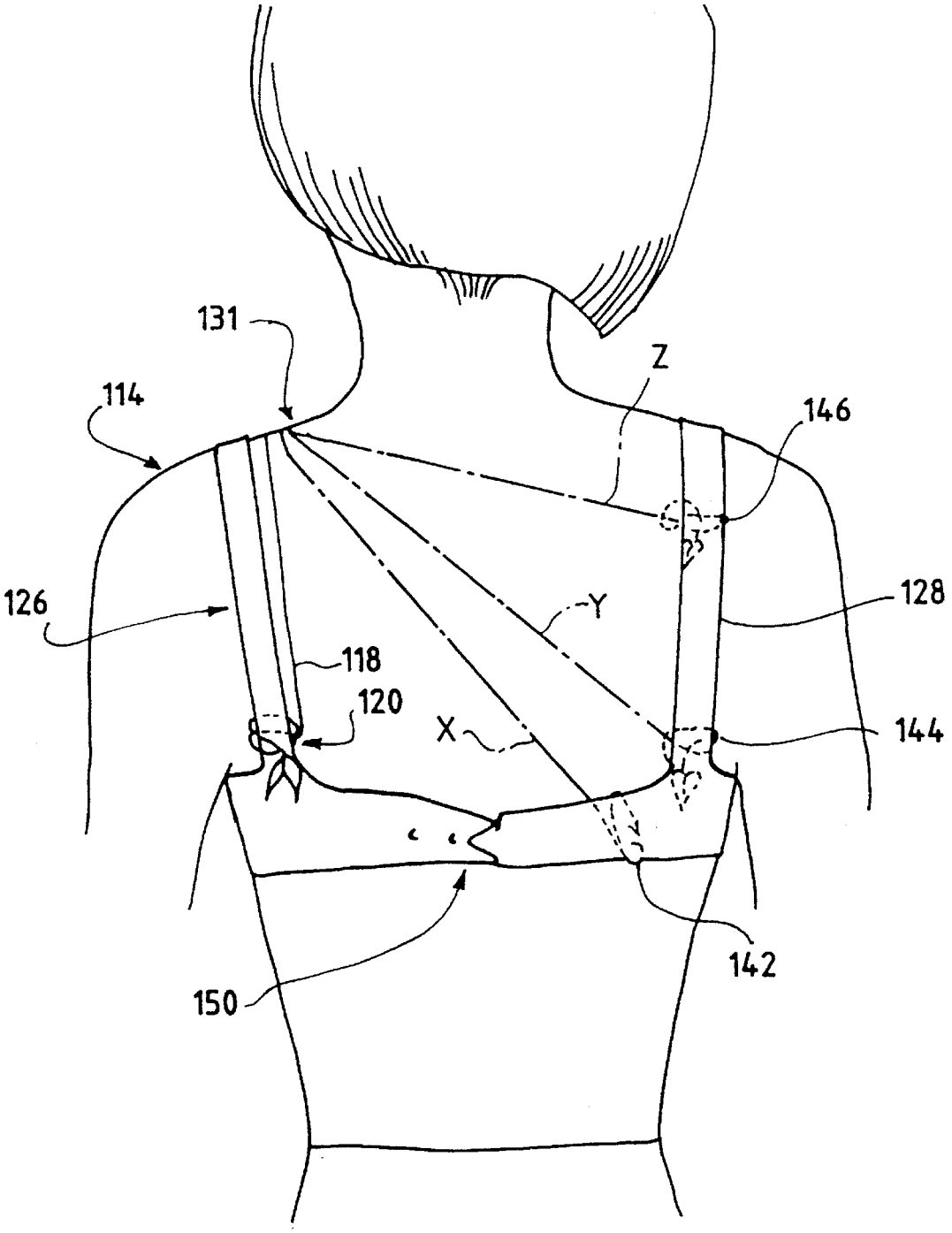
FIG. 6A is a rear elevational view of the body decoration of FIG. 6, depicting the possible points of attachment of the securing wire to the undergarment on the back of the user.

Another embodiment of the present invention is illustrated in FIGS. 6 and 6A. The body decoration 114 in FIG. 9, incorporates the ornamental element 116 and the flexible pliable wire 118 and 122 attachment means, similar to those exhibited in FIG. 5. However, in FIG. 6 and 6A the decoration 114 is worn on one side of the undergarment 124 attached to one strap 126 of the undergarment in front, then running the opposite attachment wire 118 to the rear portion of the undergarment 131 and connecting this wire 133, 137, 135 or 139 to different portions of the rear undergarment portion 150 at locations 142, 144, 146 or 148 depending on the wish of the wearer. In FIG. 6A, the wire 133 is shown connected at location 142 to undergarment strap 126. It should be understood that wire 131 could also be placed in virtually any position, including 135, 137 and 139, and the point of attachment could be at any location along either undergarment strap 126 or 128, or the horizontal portion of the undergarment connecting means 150 such as at locations 142, 144, 146 and 148.

Figure 7:
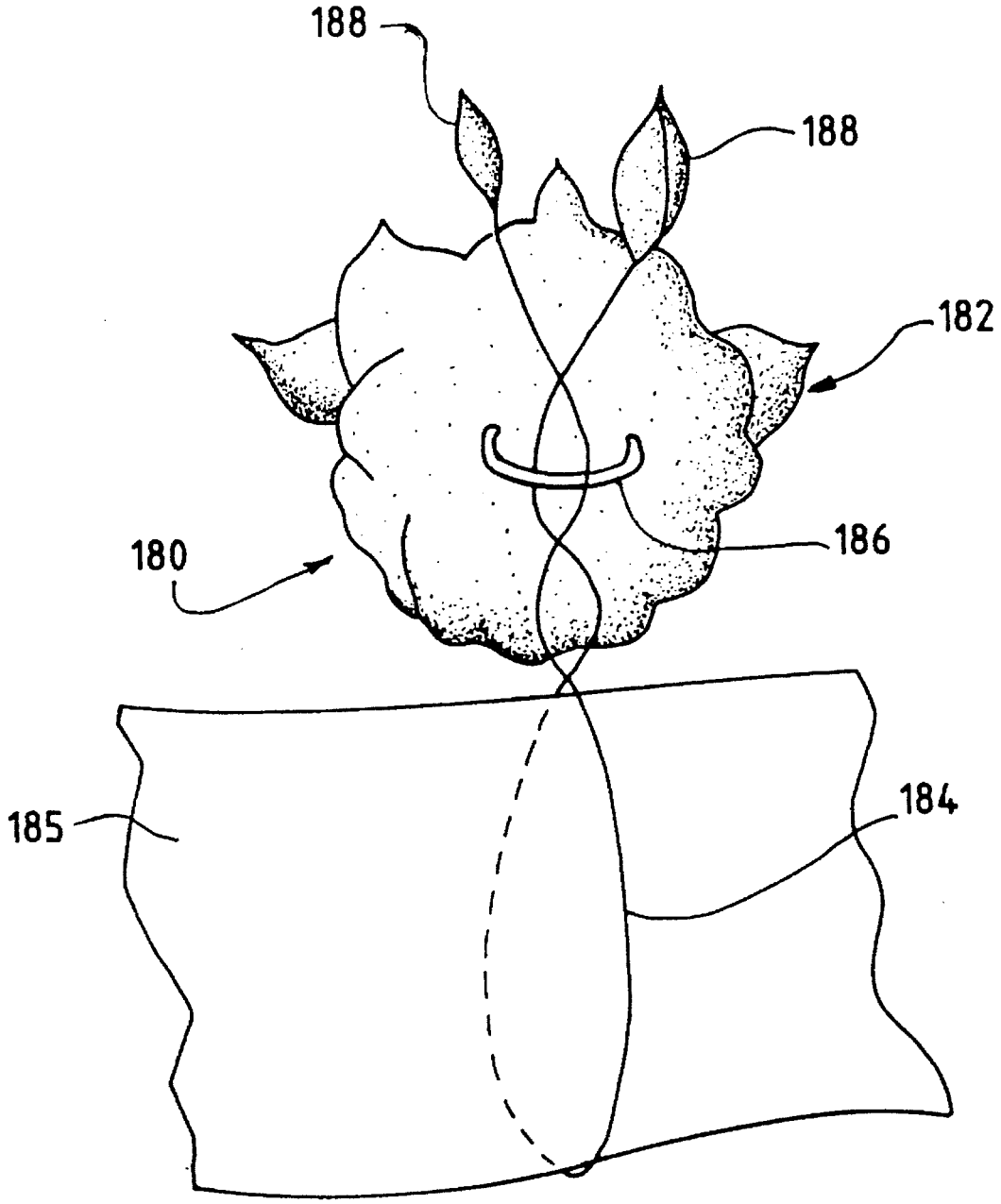
FIG. 7 is a rear elevational view of a further body decoration constructed in accordance with the present invention, illustrating greater detail with respect to the connection means.

Yet another embodiment of the present body decoration invention may be connected solely to the mid-section of the undergarment. This body decoration 180, as shown in FIG. 7, has an ornamental element 182 and a flexible pliable wire 184. The wire 184 is looped around the midsection of the undergarment 185 in a similar fashion to that shown in FIG. 5. This is the only connection point for decoration 73 in that the flexible pliable wire distal ends, reference character 75 of FIG. 5, are not present in this embodiment.

In operation, to attach body decoration 180, a user holds the ornamental element 182 above the midsection of the undergarment. The flexible pliable wire 184 is looped around the midsection of the undergarment 185, twisted, then the wire is passed through a U-shaped member 186 mounted on the rear of the ornamental element 182, and twisted again to adjust for the correct tightness. In this way, the body decoration 180 is held securely in place attached to the undergarment of the wearer.

Figure 8:
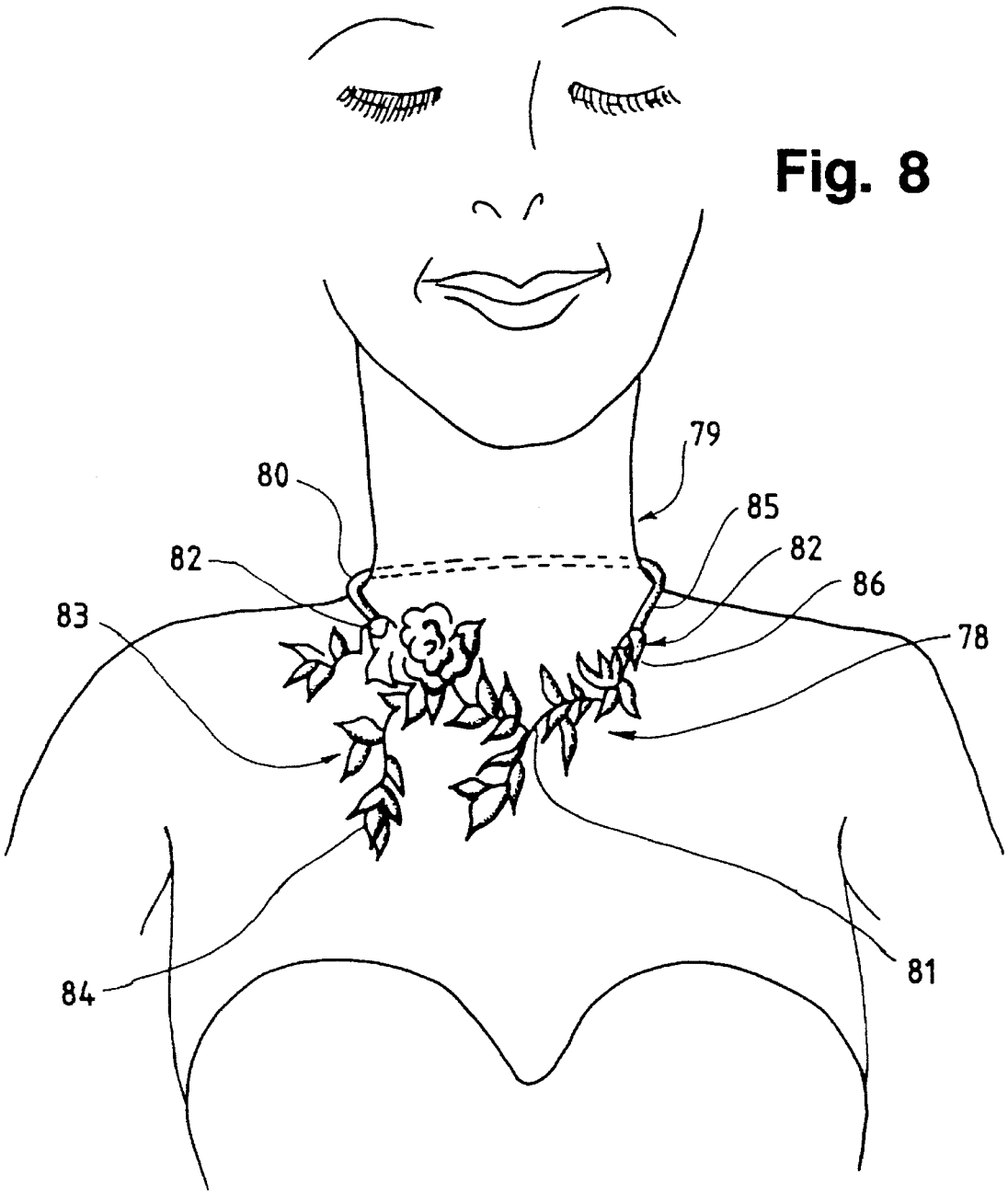
FIG. 8 is a front elevational view of yet a further body decoration, which is constructed in accordance with the present invention, and which is shown attached in place around the neck of the wearer.

Referring now to FIG. 8, there is shown a body decoration 78, in place around the lower neck 79 of a wearer. The ornamental element 83 is connected to a fine threadlike line 80 which forms a closed loop when attached to one distal end 82 of the ornamental element 83. The fine threadlike line 80 surrounds the neck 79 of the user and the closed loop end 85 is connected to the ornamental member 83 by looping over a barblike portion 86 of the ornamental member 83 located on the opposite end of the fine threadlike line attachment point 82. The ornamental member 83 consists of a large single ornamental body and numerous smaller ornamental bodies 84 extending along a flexible pliable wire 81.

Figure 8A:
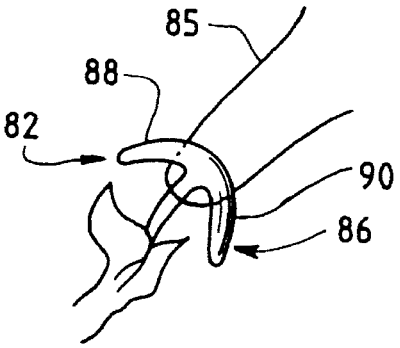
FIG. 8A shows an enlarged front elevational view of the connection point for the body decoration illustrated in FIG. 8.

Considering now the body decoration 78 in greater detail with reference to FIGS. 8 and 8A, the decoration is worn around the lower neck 79 of a wearer. An ornamental element 83 has permanently attached to it a fine threadlike line 80 which forms a closed loop. FIG. 8A illustrates this connection means in greater detail. A portion of the decoration 86 is fashioned so that the open loop 85 of the threadlike line 80 can be attached thereof by looping the fine threadlike line over rigid barbs 88 and 90 shaped to hold the line 80 in place on the distal end 86 of the decoration 78. In this way, the appearance of the wearer is greatly enhanced because the supporting fine threadlike line is less visible to an observer. The flexible pliable wire 81 having the ornamental bodies 84 can be twisted to tighten or adjust the overall length of the body decoration 78 depending on the wish of the wearer.

Figure 9:
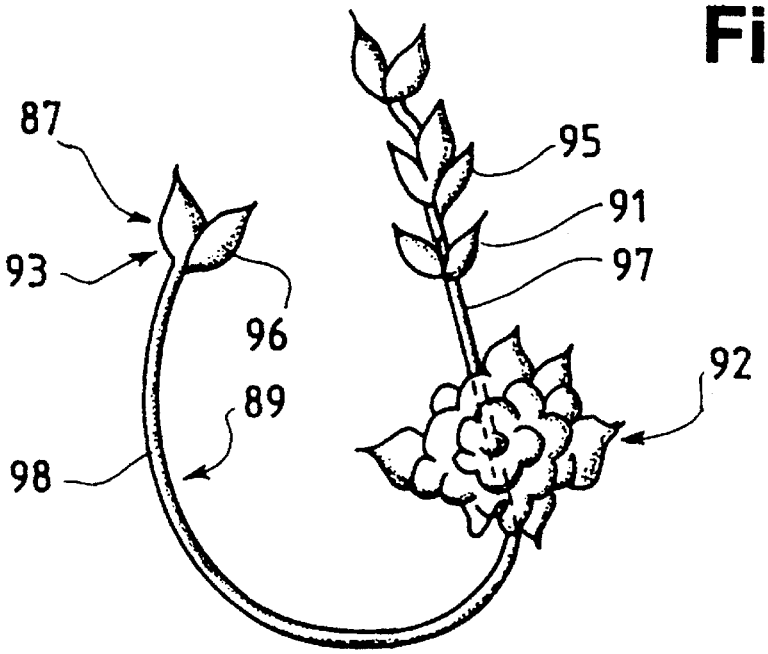
FIG. 9 is a front elevational view of another body decoration, which is also constructed in accordance with the present invention, and FIG. 9A a front elevational view of a body decoration shown attached in place around the finger of the wearer.
Figure 9A:
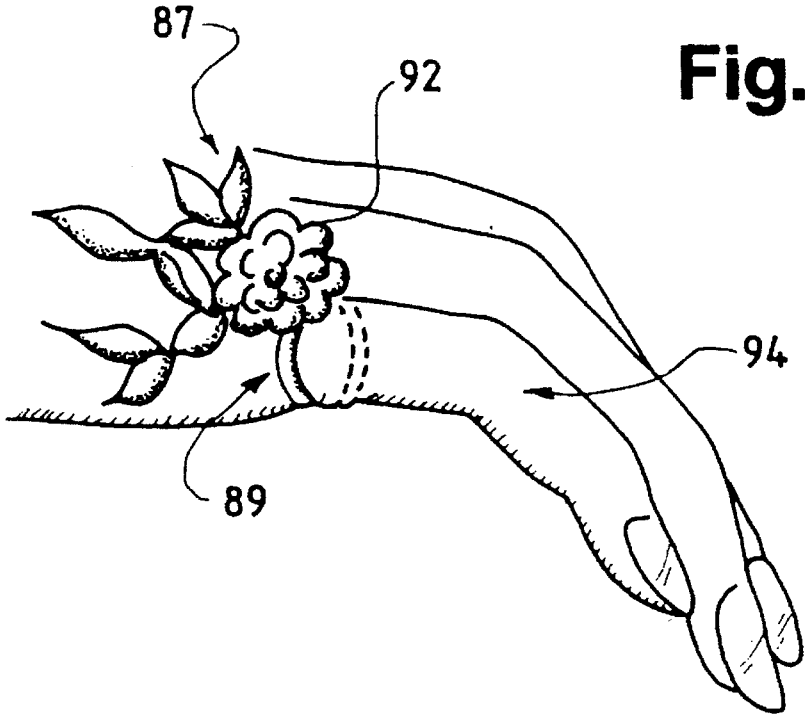

Referring now to FIG. 9 and 9A, there is shown a body decoration 87 in FIG. 9, and that body decoration in place on the finger 94 of a wearer in FIG. 9A. The body decoration 87 of this embodiment of the present invention has a smaller ornamental element 92 relative to the other embodiments. The ornamental element 92 is connected to a flexible pliable wire 89. The distal ends of the flexible pliable wire 91 and 93 contain ornamental bodies 95 and 96, respectively. Interposed between the ornamental element 92 and the ornamental bodies 95 of one distal end 91 is a short segment 97 of the wire 89. Similarly, interposed between the ornamental element 92 and the opposite distal end 93 is a somewhat longer segment of a wire 98. Both segments of wire 97 and 98 are devoid of ornamental bodies.

In use, the decoration 87 is placed onto the finger 94 of the wearer as shown in FIG. 9A. Wire segments 97 and 98 are then twisted to connect them together, with the number of turns being dictated by the size of the wearer's finger 94. In this way, the ornamental bodies 95 and 96 are brought together, while the twisted together section of wires 97 and 98 are hidden from view. This enhances the appearance of the wearer and at the same time affords the desired versatility that "one size fits all."

Figure 10:
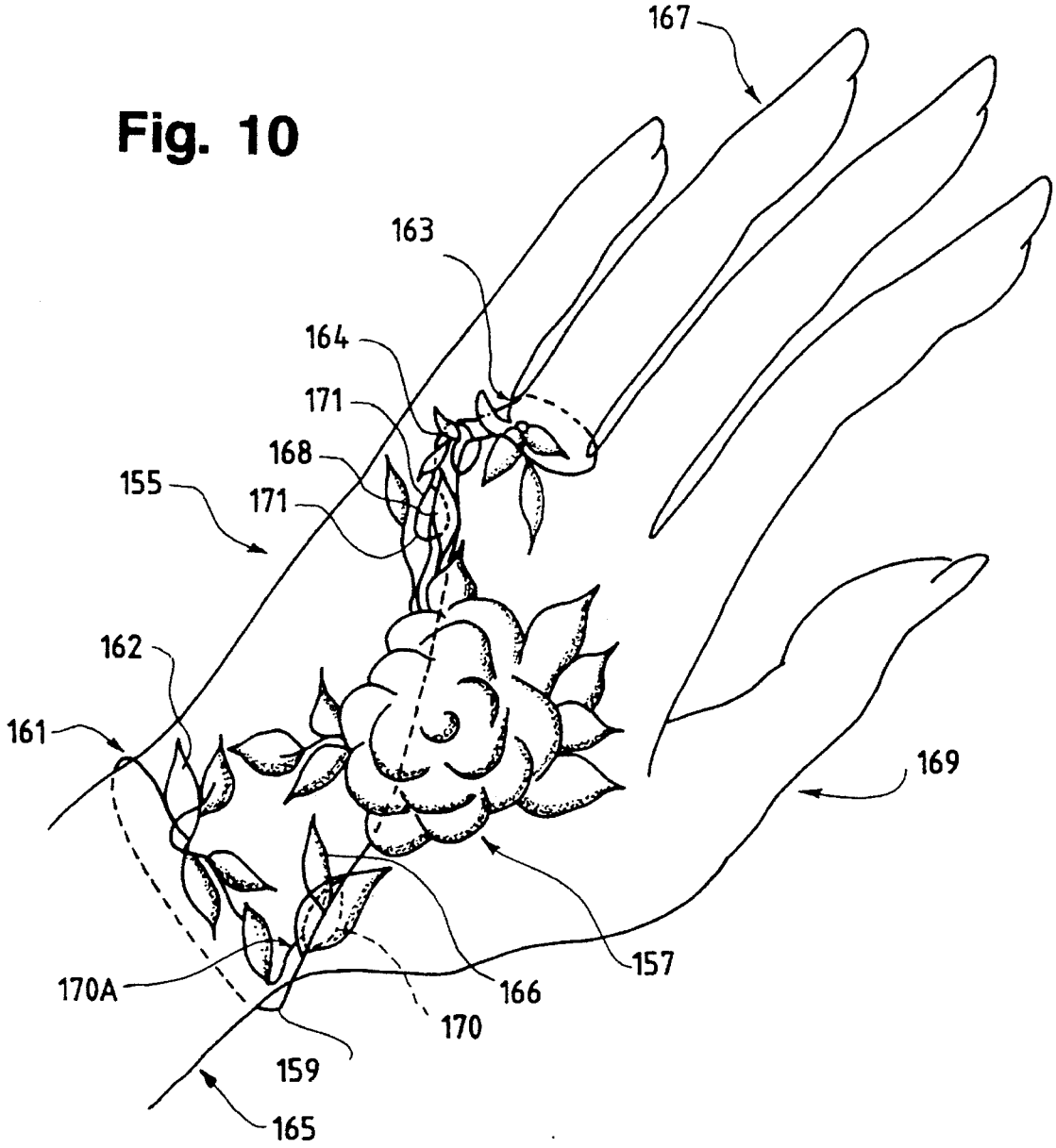
FIG. 10 is a pictorial view of another body decoration which is also constructed in accordance with the present invention, and which is shown attached in place on the back of the hand of the wearer.

Referring now to FIG. 10, there is shown a body decoration 155, in place on the back of the hand 169 of a wearer. The ornamental element 157 is connected to a flexible pliable wire 161 parts of which are embellished with ornamental bodies 162 and 164. Rigid barbs 166 and 168 are disposed at the upper and lower ends of the ornamental element 157 respectively. The lower distal end of the wire 161 is wrapped around the wearer's wrist 165 and a loop of wire 170 at the very distal end 170A of the flexible pliable wire 161 is connected to the rigid barbs 166 to secure the decoration on the wrist 165 of the wearer. On the opposite distal end 163, another loop of flexible pliable wire 171 loops around another rigid barb 168 to secure the decoration 155 to the finger 167 of the wearer. With the wrist 165 and finger 167 of the wearer acting as anchoring points, the decoration fits snugly and comfortably, without undesired shifting of position, relative to the back of the hand 169 of the user.

In operation, the body decoration 155 is placed onto the back of the hand 169 of the wearer. The distal end 163 of the flexible pliable wire 161 is wrapped around the finger 167 and the very distal end loops of wire 171 is looped over the rigid barb 168 to secure the upper portion of the decoration 155 to the finger 167 of the wearer. Next, the other distal end 170A of the wire 161 is wrapped around the wrist 165 of the wearer's hand 169. Again, the very distal end loop 170 is placed over the rigid barb 166 to secure the lower portion of the decoration 155 to the wrist 165 of the wearer. In this way, the upper and lower portions of the decoration are secured to the finger 167 and wrist 165 of the wearer to hold the decoration in place without shifting relative to the hand 169 of the wearer. Different sizes of wearer's hands may be accommodated by varying the number of times the flexible pliable wire 161 is wrapped about the finger 167 and the wrist 165 of the wearer.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A body decoration, comprising:

a body engageable decorative member bearing an ornamental element for enhancing the appearance of the user;

a flexible pliable wire connected to said decorative member for helping to support said decorative member on the body of the wearer, wherein said flexible pliable wire engages the body generally along the groove formed by the intersection of the head and the ear; and a cushion member coupled slidably to said flexible pliable wire for conforming to the groove to facilitate the support of the decorative member comfortably from the ear.

2. A body decoration according to claim 1, further including:

a fine threadlike line connected to said decorative member for helping to support said decorative member in place on the body of the user in an inconspicuous manner when worn by the user; and whereby said decorative member is at least partially supported by said line on the body of the user with said wire disposed within the groove to reduce shifting of said decorative member relative to the body of the user.

3. A body decoration according to claim 2, wherein said threadlike line helps to define a loop for encircling a portion of the body of the user to support said decorative member from the encircled body portion.

4. A body decoration according to claim 3, wherein said loop is defined by said threadlike line connected between said flexible pliable wire and said decorative member for receiving the ear of the user therein to stabilize said decorative member on the body of the user so that said decorative member remains in place about the ear of the user.

5. A body decoration according to claim 3, wherein said threadlike line has a pair of end portions and said loop includes another flexible pliable wire connected between the end portions for being twisted manually to adjust the size of the loop so that said loop tightens securely in place about the body portion.

6. A body decoration according to claim 5, wherein said loop generally encircles the head for stabilizing said decorative member to reduce shifting of said decorative member relative to the body of the user.

7. A body decoration according to claim 1, wherein said cushion member includes a malleable puttylike substance to cushion the body decoration so that the body decoration is more comfortable for said user to wear.

8. A body decoration according to claim 7, wherein said puttylike substance includes a silicone clear putty, suitable for conforming to the human ear shapes.

9. A body decoration according to claim 8, wherein said cushion device includes a fabric covering for containing the puttylike substance.

10. A body decoration according to claim 9, wherein said wire includes an inner wire and a colored plastic coating surrounding said wire.

11. A body decoration according to claim 1, wherein said decorative member has an inner surface and is adapted to be worn at the face adjacent to an ear of a user;

said flexible pliable wire being secured to said inner surface for supporting said main body on the face portion;

said flexible pliable wire engages the ear at substantially the entire length of the groove to help support the decorative member on the face portion; and wherein said flexible pliable wire is twistably adjustable to enable it to conform closely to the groove for cooperating with the cushion member to comfortably support the decorative member on the face portion from the ear.

12. A face decoration according to claim 11, wherein said flexible pliable wire helps to define a closed loop configuration for encircling the ear.

13. A face decoration according to claim 12, wherein said flexible pliable wire includes a free distal end and a proximate end connected to said decorative member, said closed loop configuration further includes a fine threadlike line connected between said proximate end and said decorative member to form said closed loop configuration, wherein said fine threadlike line further facilitates the support of said decorative member in an inconspicuous manner.

14. A method of using a body decoration, comprising:

positioning a decorative member on the body of the wearer;

adjusting a flexible pliable wire connected to the decorative member for engaging the body of the wearer generally along the groove formed by the intersection of the head and the ear to help support the decorative member on the body of the wearer in a desired location in a comfortable and secure manner; and positioning a cushion member coupled slidably to said flexible pliable wire to facilitate the support of the decorative member comfortably from the ear.

15. A method according to claim 14, comprising:

bending said flexible pliable wire to conform to the groove;

forming said cushion member to conform to the outer groove portion formed by the intersection of the upper pinna ear portion and the head of the wearer;

positioning a line having another flexible pliable wire around the crown of the head and adjusting said line to the size of the head of the wearer by twisting adjustably said another flexible pliable wire.

* * * * *